United States Patent [19]

Slattery et al.

[11] Patent Number: 4,846,118

[45] Date of Patent: Jul. 11, 1989

[54] DUEL FUEL PUMP AND OIL-FUEL MIXING VALVE SYSTEM

[75] Inventors: Gordon C. Slattery, Omro; Ronald D. Stageman, Campbellsport; John F. Garms, Menasha, all of Wis.

[73] Assignee: Brunswick Corporation, Skokie, Ill.

[21] Appl. No.: 206,614

[22] Filed: Jun. 14, 1988

[51] Int. Cl.[4] ..... F02B 33/04; F01M 3/02

[52] U.S. Cl. ..... 123/73 AD

[58] Field of Search ..... 123/73 AD, 196 R, 198 C

[56] References Cited

U.S. PATENT DOCUMENTS

| | | | |
|---|---|---|---|
| 3,913,551 | 10/1975 | Shaver | 123/73 AD X |
| 3,924,975 | 12/1975 | Hundertmark | 417/395 |
| 4,388,896 | 6/1983 | Sheridan et al. | 123/73 AD |
| 4,471,728 | 9/1984 | Borst et al. | 123/73 AD |
| 4,583,500 | 4/1986 | Hundertmark | 123/73 AD |
| 4,638,771 | 1/1987 | Mori | 123/73 AD |
| 4,726,330 | 2/1988 | Shiga | 123/73 AD |
| 4,730,580 | 3/1988 | Matsushita | 123/73 AD |

OTHER PUBLICATIONS

Mercury Marine Brunswick Corp., Quicksilver Parts Catalog 20 H.P. 25 H.P., 90-18583, Sep. 1987, pp. 14–15.

*Primary Examiner*—Willis R. Wolfe

*Attorney, Agent, or Firm*—Andrus, Sceales, Starke & Sawall

[57] ABSTRACT

A marine propulsion system (2) with an outboard engine (4) has an oil-fuel mixing valve (16) within the engine cowl (6). A first crankcase pressure driven fuel pump (20) delivers fuel from a remote fuel tank (14) to the mixing valve, and a second crankcase pressure driven fuel pump (22) delivers mixed oil-fuel from the mixing valve to the engine. The arrangement provides adequate fuel pressure to overcome the added pressure drop across a reduced size mixing valve, all fitting within the engine cowl. The crankcase pressure pulses to the fuel pumps are 180° out of phase such that when the first pump is pushing pressurized fuel to the inlet of the mixing valve, the second pump is pulling suctioned oil-fuel from the outlet of the mixing valve, to increase fuel pressure differential and enhance operation of the mixing valve.

6 Claims, 1 Drawing Sheet

DUEL FUEL PUMP AND OIL-FUEL MIXING VALVE SYSTEM

BACKGROUND AND SUMMARY

The invention relates to marine propulsion systems with automatic oil-fuel mixing for a two cycle crankcase compression internal combustion engine.

Marine propulsion systems with automatic oil-fuel mixing is shown in commonly owned copending U.S. application Ser. No. 07/182,180, filed Apr. 15, 1988, entitled "Marine Engine With Combination Vapor Return, Crankcase Pressure, And Cooled Fuel Line Conduit", still pending, U.S. Pat. No. 4,583,500, entitled "Marine Propulsion System With Automatic Oil-Fuel Mixing", incorporated herein by reference. The mixing valve automatically mixes oil and fuel, and eliminates the need to premix same. The valve has a fuel inlet, an oil inlet, and an oil-fuel outlet, and is operated by a pressure differential between the fuel inlet and the oil-fuel outlet across a diaphragm as shown at 24 in FIG. 2 and at 324 in FIG. 6 of U.S. Pat. No. 4,583,500. The mixing valve may be connected downstream of the fuel pump and use the fuel pressure to operate the mixing valve. Alternatively, the mixing valve may be connected upstream of the fuel pump and use the fuel pump suction to operate the mixing valve. In other applications where a pressurized fuel tank is utilized, such pressure may be used to operate the valve. In other implementations, crankcase pressure and/or vacuum may be used to operate the valve, or a separate dedicated small pump may be used, all as noted in U.S. Pat. No. 4,583,500.

The present invention arose during development efforts directed toward reducing the size of the oil-fuel mixing components and system to enable such system to fit inside the engine cowl of an outboard two cycle internal combustion engine. The invention provides a dual fuel pump arrangement accomplishing such objective.

The oil-fuel mixing valve was previously external to the engine cowl. The external mixing valve was provided with a large diaphragm to operate the mechanism and pump oil in response to fuel pressure differential. The diaphragm was made as large as possible to reduce the pressure drop across the diaphragm between the fuel inlet and the oil-fuel outlet of the mixing valve. This was necessary in implementations where the mixing valve is connected upstream of the fuel pump, and the fuel is drawn or pulled through the mixing valve by fuel pump suction. The pressure drop across the diaphragm must be as low as possible because fuel will otherwise vaporize in a vacuum.

In order to reduce the size of the mixing valve to enable it to fit within the engine cowl, a smaller diaphragm or piston must be used. This increases the pressure drop across the diaphragm, and in turn requires that the mixing valve be connected downstream of the fuel pump so that pressurized fuel is pushed into the mixing valve. This minimizes the fuel vaporization problem. However, to accomplish such arrangement economically and in a small package was found to be very difficult.

In various marine propulsion systems, such as those including a Mercury Marine 25 horsepower outboard two cycle engine, a crankcase pressure driven fuel pump is provided which is integral with the carburetor Mercury Marine Brunswick Corp. Quicksilver Parts Catalog 20 H.P. 25 H.P., 90-18583, September 1987, page 14–15. This is more economical than mounting the fuel pump on the engine block crankcase and running hoses to the carburetor, as is done on larger engines. However, this arrangement is not suitable for the above noted mixing application with a smaller mixing valve because the mixing valve would be upstream of the fuel pump.

The present invention provides the above noted mixing application and enables a reduced size mixing valve to fit within the engine cowl without sacrificing the economical mounting arrangement noted above for Mercury Marine 25 HP applications and the like if desired. The invention enables the use of known relatively small and inexpensive crankcase pulse pressure driven fuel pumps. A first fuel pump draws fuel from a remote fuel tank and supplies pressurized fuel to the inlet of the mixing valve. This minimizes the above noted vaporization problem. This first fuel pump by itself is not sufficient to supply the requirements of the engine. A second fuel pump draws oil-fuel from the outlet of the mixing valve and supplies same to the engine. The fuel pumps may be integral with the mixing valve and the carburetor, respectively, or may be separate.

In the preferred embodiment, the fuel pumps receive crankcase pressure pulses from crankcase chambers whose cylinders are 180° out of phase with each other. In this manner, while the first pump is pushing pressurized fuel to the inlet of the mixing valve, the second pump is pulling suctioned oil-fuel from the outlet of the mixing valve. This increases overall pressure and capacity.

The system in accordance with the invention offers superior performance, lower cost, and smaller package size than previous single pump arrangements.

DETAILED DESCRIPTION

Figure 1:
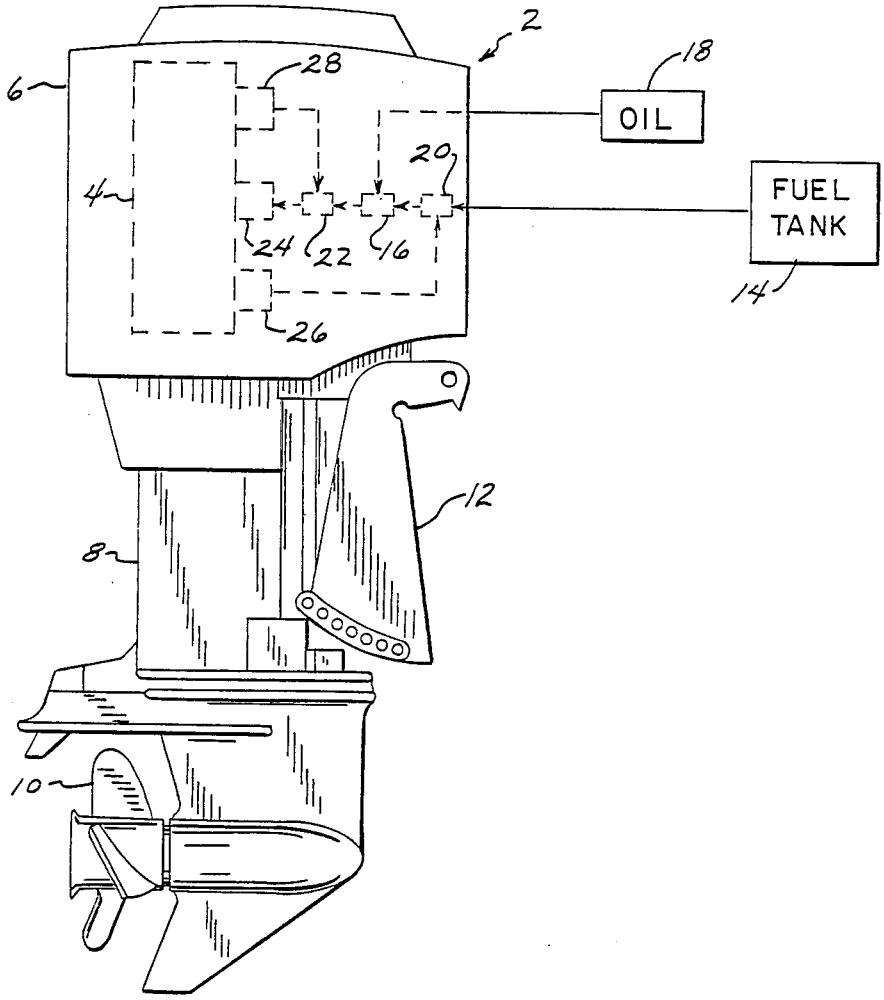
FIG. 1 shows a marine propulsion system in accordance with the invention.
Figure 2:
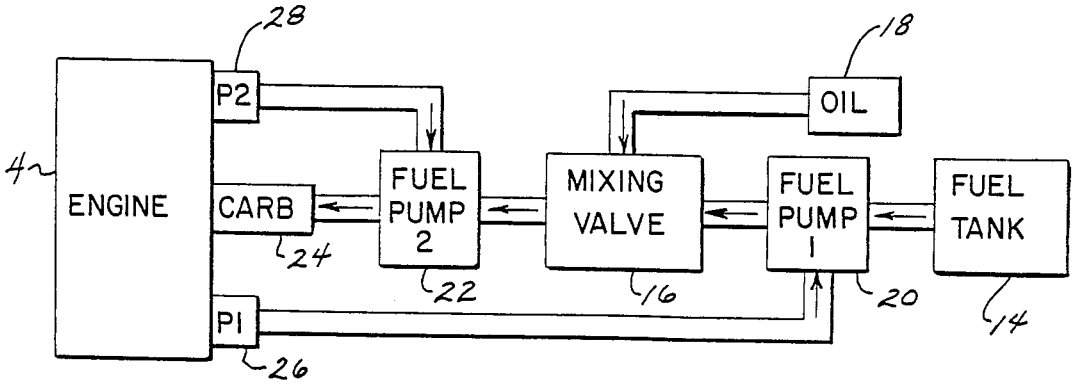
FIG. 2 shows the dual fuel pump and mixing valve arrangement of FIG. 1.

FIG. 1 shows a marine propulsion system including an outboard propulsion unit 2 having a power head with a two cycle crankcase compression internal combustion engine 4 within a cowl 6 and having a lower depending gearcase 8 and propeller 10. Outboard propulsion unit 2 is mounted to the transom of a boat (not shown) by transom bracket 12. A remote fuel tank 14 is within the boat. An oil-fuel mixing valve 16, FIGS. 1 and 2, such as shown in incorporated U.S. Pat. No. 4,583,500, is provided within cowl 6 and mixes oil from oil source 18 with fuel from fuel tank 14. A first fuel pump 20 delivers fuel from fuel tank 14 to mixing valve 16. A second fuel pump 22 delivers mixed oil-fuel from mixing valve 16 to engine 4 at carburetor 24, or to the fuel injection system of the engine if so equipped, preferably at a vapor separator upstream of the high pressure fuel injection pump. Each of fuel pumps 20 and 22 is a crankcase pressure pulse driven pump, Mercury Marine Brunswick Corp. *Outboard Service Training Notebook,* Bulletin 90-90592 3–1286, pages 10–11. The fuel pumps are driven by crankcase pressure pulses from respective crankcase pressure ports 26 and 28, preferably corresponding to crankcase chambers of cylinders which are 180° out of phase, U.S. Pat. No. 3,924,975, incorporated herein by reference.

Both fuel pumps 20 and 24 are within cowl 6. Mixing valve 22 is operated by fuel pressure differential between the pumps. The fuel inlet of the mixing valve is connected to the pressurized output side of fuel pump 20. The oil-fuel outlet of the mixing valve is connected to the suction intake side of fuel pump 22. Mixing valve 22 has a diaphragm, incorporated U.S. Pat. No. 4,583,500, moved by the fuel pressure differential. The present invention enables the lateral area of the diaphragm to be reduced sufficiently to enable sufficient reduction in size of the mixing valve to enable placement of the mixing valve within the engine cowl. The reduced lateral area of the diaphragm causes greater fuel pressure drop across the diaphragm which in turn requires that the mixing valve be driven by fuel pressure at its inlet rather than solely by fuel suction at its outlet, which suction and resultant vacuum would otherwise cause vaporization of fuel. Fuel pump 20 supplies pressurized fuel to the mixing valve to drive the latter. Fuel pump 20 has insufficient capacity to supply the requirements of the engine without the addition of fuel pump 22. The system provides adequate fuel pressure to overcome the added pressure drop across the reduced size mixing valve.

As above noted, fuel pump 20 receives crankcase pressure pulses which are 180° out of phase with the crankcase pressure pulses received by fuel pump 22. When fuel pump 20 is pushing pressurized fuel to the inlet of mixing valve 16, fuel pump 22 is pulling suctioned oil-fuel from the outlet of mixing valve 16. This increases fuel pressure differential across the mixing valve and enhances operation of the mixing valve.

It is recognized that various equivalents, alternatives and modifications are possible within the scope of the appended claims.

We claim:

1. A marine propulsion system comprising an outboard two cycle internal combustion engine within a cowl, a remote fuel tank, an oil-fuel mixing valve within said cowl mixing oil, from an oil source with fuel from said fuel tank, a first automatically operated fuel pump delivering fuel from said fuel tank to said mixing valve, a second fuel pump delivering mixed oil-fuel from said mixing valve to said engine.

2. A marine propulsion system comprising an outboard two cycle internal combustion engine within a cowl, a remote fuel tank, an oil-fuel mixing valve within said cowl mixing oil from an oil source with fuel from said fuel tank, a first fuel pump delivering fuel from said fuel tank to said mixing valve, a second fuel pump delivering mixed oil-fuel from said mixing valve to said engine, wherein both of said fuel pumps are within said cowl.

3. A marine propulsion system comprising an outboard two cycle internal combustion engine within a cowl, a remote fuel tank, an oil-fuel mixing valve within said cowl mixing oil from and oil source with fuel from said fuel tank, a first fuel pump delivering fuel from said fuel tank to said mixing valve, a second fuel pump delivering mixed oil-fuel from said mixing valve to said engine, wherein said mixing valve is operated by fuel pressure differential between said first and second fuel pumps.

4. The invention according to claim 3 wherein said mixing valve has an inlet connected to the pressurized output side of said first fuel pump, and has an outlet connected to the suction intake side of said second fuel pump.

5. The invention according to claim 4 wherein said mixing valve has a diaphragm moved by fuel pressure differential, and wherein said diaphragm has a lateral area reduced sufficiently to enable sufficient reduction of the size of said mixing valve to enable placement of said mixing valve within said cowl, said reduced lateral area of said diaphragm causing greater fuel pressure drop across said diaphragm which in turn requires that said mixing valve be driven by fuel pressure at its inlet rather than solely by fuel suction at its outlet, which suction and resultant vacuum would otherwise cause vaporization of fuel, said first fuel pump supplying pressurized fuel to said mixing valve to drive the latter, said first fuel pump having insufficient capacity to supply the requirements of said engine without the addition of said second fuel pump.

6. A marine propulsion system comprising an outboard two cycle multi-cylinder internal combustion engine, a remote fuel tank, an oil-fuel mixing valve operated by fuel pressure differential to mix oil from an oil source with fuel from said fuel tank, a first crankcase pressure driven fuel pump delivering fuel from said fuel tank to an inlet of said mixing valve in response to crankcase pressure pulses, a second crankcase driven fuel pump delivering mixed oil-fuel from an outlet of said mixing valve to said engine in response to crankcase pressure pulses 180° out of phase with said first mentioned crankcase pressure pulses, such that when said first pump is pushing pressurized fuel to said inlet of said mixing valve, said second pump is pulling suctioned oil-fuel from said outlet of said mixing valve, to increase said fuel pressure differential and enhance operation of said mixing valve.

* * * * *